United States Patent [19]

Vogt

[11] Patent Number: 4,729,616

[45] Date of Patent: Mar. 8, 1988

[54] DRAWERS FOR SINK CABINETS

[75] Inventor: James B. Vogt, Ada, Mich.

[73] Assignee: Vogt Industries, Inc., Kentwood, Mich.

[21] Appl. No.: 938,873

[22] Filed: Dec. 8, 1986

[51] Int. Cl.[4] ..... A47B 88/00

[52] U.S. Cl. ..... 312/325; 312/266; 220/74; 220/23.4; 220/332; 220/333

[58] Field of Search ..... 220/74, 23.4, 23.83, 220/DIG. 6, 66, 332, 333; 312/228, 229, 325, 326, 327, 328, 266

[56] References Cited

U.S. PATENT DOCUMENTS

| | | | |
|---|---|---|---|
| 683,892 | 10/1901 | Bachia | 312/31 X |
| 1,888,345 | 11/1932 | Cummings . | |
| 2,130,663 | 9/1938 | Baker . | |
| 2,673,003 | 3/1954 | Stewart | 220/74 |
| 3,292,983 | 12/1966 | Service . | |
| 3,425,766 | 2/1969 | Crisera . | |
| 3,698,783 | 10/1972 | Swett et al. | 312/229 X |
| 4,241,963 | 12/1980 | Seidel . | |

FOREIGN PATENT DOCUMENTS

| | | | |
|---|---|---|---|
| 2359467 | 6/1975 | Fed. Rep. of Germany . | |
| 2614906 | 10/1977 | Fed. Rep. of Germany | 312/325 |
| 2806618 | 8/1979 | Fed. Rep. of Germany . | |

*Primary Examiner*—Joseph Falk

*Attorney, Agent, or Firm*—Varnum, Riddering, Schmidt & Howlett

[57] ABSTRACT

A hinge assembly mounting a drawer panel on a sink cabinet for movement between closed and open positions in which a tray movable with the drawer panel is contained within the cabinet and in which it is accessible from without the cabinet. The hinge assembly is concealed from view when the drawer panel is in the closed position, and the drawer panel is wholly spaced from the cabinet in the open position. The drawer panel is constructed to move between the open and closed positions in a single curved path.

7 Claims, 10 Drawing Figures

DRAWERS FOR SINK CABINETS

FIELD OF THE INVENTION

This invention relates to cabinets and more particularly to sink cabinets. Still more particularly, the invention relates to hinge assemblies for mounting receptacles on sink cabinets for movement between positions within and without the cabinets.

BACKGROUND OF THE INVENTION

For many years it has been the almost invariable fashion to incorporate sink cabinets in newly constructed or remodeled kitchens. Such cabinets, usually constructed of wood or sometimes of metal, are conventionally provided with a top panel or counter, in which at least one sink is supported in an appropriately configured opening, and a front panel, in which are provided openings of various sizes and configurations for access to storage compartments, drawers, or spaces for drain and water supply conduits. Normally the cabinet enclosure is completed in the rear by a wall of the building, at the sides by additional panels, building walls, panels of other cabinets, or combinations of such elements, and at the base by the kitchen floor or by base panels spaced above the floor.

Sink cabinets are frequently installed in bathrooms as well, where they are sometimes referred to as "vanities" from their resemblance to dressing tables. General features of construction of bathroom sink cabinets are identical with or closely similar to those of kitchen sink cabinets. However, sink cabinets for bathrooms, normally being smaller, are more frequently prefabricated in factory or shop.

The designer or builder of sink cabinets is continually confronted with the problem of what to do with the space within the cabinet roughly defined by the inner surfaces of the top and front panels, the outer front surface of the sink, and the plane of the bottom of the sink extended to intersect the front panel. This space is normally quite small in the transverse dimension; that is, the distance between the inner surface of the front panel and the front surface of the sink. Therefore, it is not regarded as suitable to receive a conventional sliding drawer. The most frequent answer to the problem has been to do nothing at all by leaving the front panel unbroken in the area in front of the sink, sometimes applying a false drawer panel for uniformity or ornamental effect. In most such cases care is taken not to affix any sort of drawer pull, the presence of which might induce users to attempt to open the "drawer".

On the other hand, a number of expedients have been devised to make practical use of the space in question. Among these are the devices disclosed in U.S. Pat. No. 3,292,983, issued Dec. 20, 1966 to C. R. Service, and U.S. Pat. No. 4,241,963, issued Dec. 30, 1980 to C. Siedel. Each of these devices comprises a so-called drop-down drawer panel which is hinged at its bottom edge to the outer surface of the front panel of a sink cabinet for purely rotational movement to and from a position in which it closes an opening in the front panel. Affixed to the inner surface of the drawer panel is a rack or tray for storing such items as toilet articles or small kitchen implements. Mechanical stops are provided to limit the opening movement of the drawer panel.

The hinges employed in such devices are completely or partially exposed, a characteristic regarded by many as unattractive, if not unsightly. Further, the "drop-down" movement of the drawer panel is entirely unlike that of a conventional sliding drawer, which it closely resembles when closed, such movement being a surprise and therefore an annoyance until the user becomes accustomed to it through repeated operation. Also in such devices, the tray or rack is securely fastened to the drop-down panel, whereby it must be cleaned in situ or disassembled from the panel for cleaning.

Concealed hinges, and hinges which permit translational movement of the closure member which they support, are not new in themselves. Examples are disclosed in U.S. Pat. No. 1,888,345, issued Nov. 22, 1932 to E. W. Cummings, U.S. Pat. No. 2,130,663, issued Sept. 20, 1938 to L. B. Baker, U.S. Pat. No. 3,425,766, issued Feb. 4, 1969 to J. E. Crisera, German Laid-Open Patent Specification No. 23 59 467, published June 5, 1975, and German Laid-Open Specification No. 28 06 618, published Aug. 23, 1979. The hinges thus disclosed are of varying degrees of complexity and provide not only for translational movement of the closure member supported by the hinges but also for pivotal movement about axes which may be displaced by the translational movement, with the result that any point on the closure member is movable through virtually an infinite number of arcs. Further, the pivotal axes are vertically disposed, since the hinges disclosed are intended to support such closure members as doors or casement-type windows. Finally, these prior devices employ a pair of hinge arms or links which are not only dissimilar in configuration, including length, but which in all but the Baker patent are constrained to move in mutually exclusive planes.

SUMMARY OF THE INVENTION

The present invention provides a storage tray of uniform cross section throughout its lenght, and a pair of hinge assemblies for supporting the tray on a sink cabinet for movement relative thereto between open and closed positions. The tray has a base wall and a pair of sidewalls upstanding from opposite sides of the base wall to define therewith opposite open ends of the tray. Each of the hinge assemblies comprises a cabinet hinge plate, a drawer hinge plate, hinge arm means supporting the drawer hinge plate on the cabinet hinge plate for movement relative thereto in a curved path, and tray support means. The cabinet hinge plate is adapted to be affixed to the cabinet, and the tray support means are carried by the drawer hinge plate for removably supporting the tray at a respective one of the opposite open ends thereof in a position whereby the drawer hinge plate forms an end wall closing the respective open end.

Specific objects, features and advantages of the invention will be apparent from the ensuing description taken in conjunction with the accompanying drawings.

THE DRAWINGS

THE PREFERRED EMBODIMENT

Construction

Figure 1:
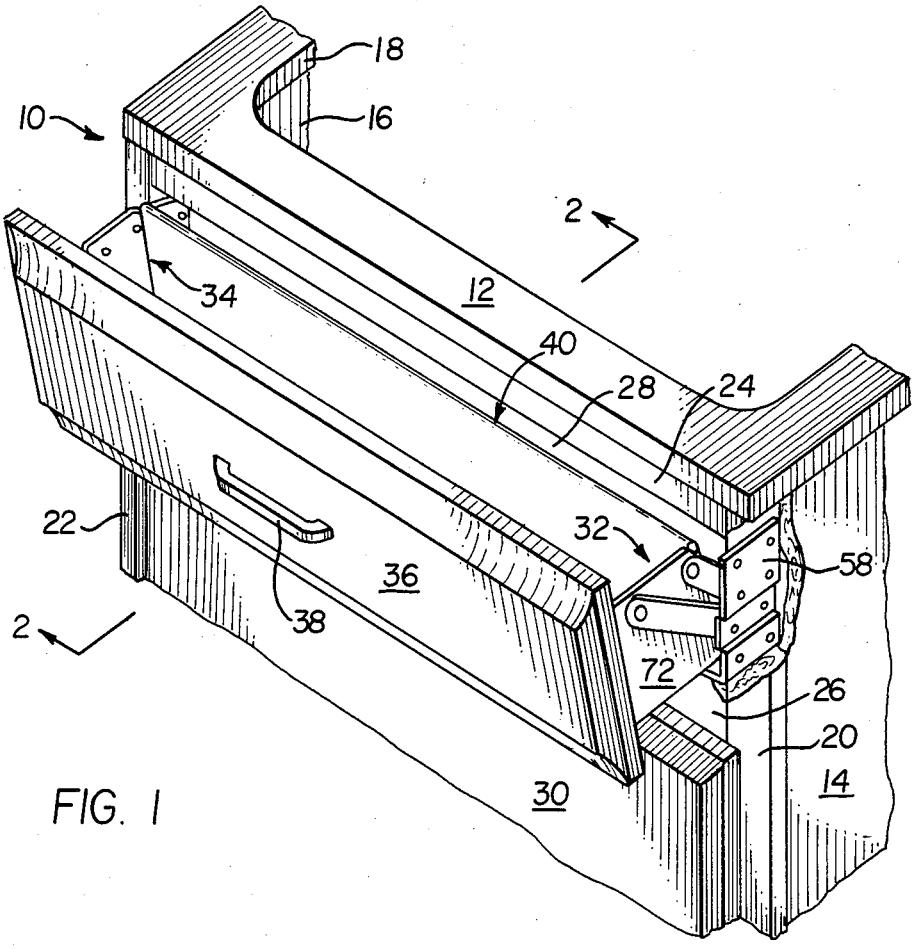
FIG. 1 is a partial perspective view of a sink cabinet incorporating features of a preferred embodiment of the present invention.

Referring particularly to FIG. 1, there is generally depicted a sink cabinet 10 having a counter or top panel 12 and vertical side panels 14 and 16. A continuous interior edge 18 of top panel 12 defines an aperture for receiving a sink (not shown) of complementary peripheral configuration in well-known manner.

Side panels 14 and 16 are joined to vertical frame members 20 and 22 and to horizontal frame members 24 and 26 extending between the vertical frame members. Frame members 20, 22, 24 and 26 cooperate to define a rectangular drawer opening 28, and the frame members cooperate with a lower panel member 30, which may comprise a cabinet door, to form a vertical front wall or panel of cabinet 10 and extending downwardly from top panel 12. Side panel 14 and vertical frame member 20 are shown partially broken away in FIG. 1.

Mounted on a pair of hinge assemblies 32 and 34 is a drawer panel 36 provided with a handle or drawer pull 38. A receptacle or tray 40 is also supported by hinge assemblies 32 and 34 but is readily removable, as will be made clear from the construction described hereinafter.

Referring now more particularly to FIGS. 2 to 6, 8 and 9, each of hinge assemblies 32 and 34 is formed of a suitable material, preferably a metal such as brass, and consists essentially of a cabinet hinge member 42, 44, a drawer hinge member 46, 48 and a pair of hinge arms 50, 52; 54, 56 supporting the drawer hinge member on the cabinet hinge member, as will be described with greater particularity hereinafter.

Cabinet hinge members 42 and 44 are identical and consist of a cabinet hinge plate 58, 60 having a transverse portion 62, 64 indented toward the corresponding drawer hinge member 46, 48. A stop means 66, 68 is formed integrally with cabinet hinge plate 58, 60 and extends at right angles from a lower side thereof. Cabinet hinge plates 58 and 60 and stop means 66, 68 are provided with a number of openings, such as those indicated at 70, to receive fastening means in the form of screws 71 (FIGS. 2 and 3) whereby to affix cabinet hinge plates 58 and 60, and thus hinge assemblies 32 and 34, to sink cabinet 10. It will be noted in FIGS. 2 and 3 that only two of openings 70 are employed in affixing each hinge assembly to the sink cabinet 10 shown in FIGS. 1 to 3. The particular openings employed will vary from installation to installation depending upon variations in the construction of the cabinets.

Drawer hinge members 46 and 48 each comprise a drawer hinge plate 72, 74 provided with a pair of embossments 76 (FIG. 6) Integral with and extending from opposite sides of drawer hinge plate 72, 74 is a pair of tray support elements 78, 80; 82, 84. A stop means 86, 88 is also integral with drawer hinge plate 72, 74 and extends at right angles therefrom and at right angles to tray support means 78, 80; 82, 84. Each of the tray support means is provided with an upper tray support edge or surface 90.

In each hinge assembly 32, 34, that cabinet hinge plate 58, 60 and drawer hinge plate 72, 74 are parallel, and that the respective hinge arms 50, 52; 54, 56 are disposed in common planes between and parallel with the cabinet hinge plate and the drawer hinge plates, the hinge arms in each pair being proximately adjacent to one another.

Each of the hinge arms 50, 52; 54, 56 has a first pivotal connection at its upper end with the respective drawer hinge plate 72, 74 and a second pivotal connection at its lower end with the cabinet hinge plate 58, 60, the pivotal connections being provided respectively by upper pivot studs 91 and lower pivot studs 92, the upper pivot studs piercing drawer hinge plates 72 and 74 at embossments 76, the lower pivot studs piercing cabinet hinge plates at indented transverse portions 62, 64, the embossments and indented portions facilitating unobstructed rotational movement of the hinge arms in their common planes.

It should be noted parenthetically that the expressions "upper" and "lower," as used herein, refer to positions and directions relative to a sink cabinet in its normal upright condition, as shown in the drawings, whereas the expressions "inner" and "outer" relate similarly to the interior and exterior, respectively, of the cabinet.

Figure 6:
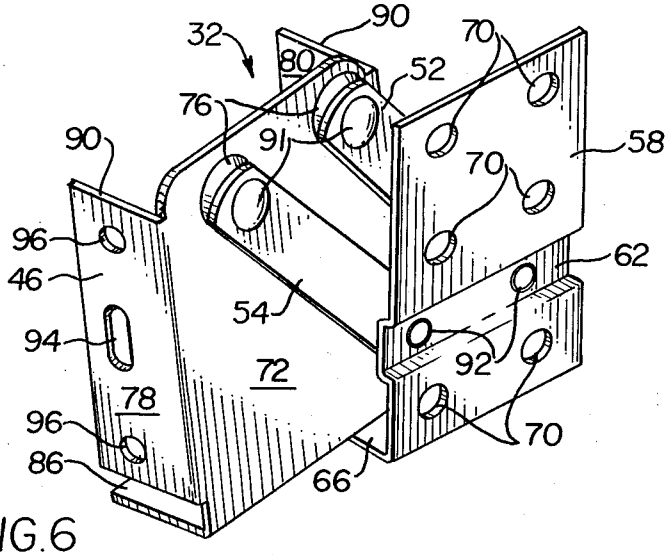
FIG. 6 is a perspective view of a hinge assembly according to the invention.

As is best seen in FIG. 6, each of the outer tray support elements 78, 80 is provided with an elongate opening 94 and a pair of circular openings 96 to receive fastening means such as screws 98 for mounting drawer panel 36 on hinge assemblies 32 and 34.

Figure 3:
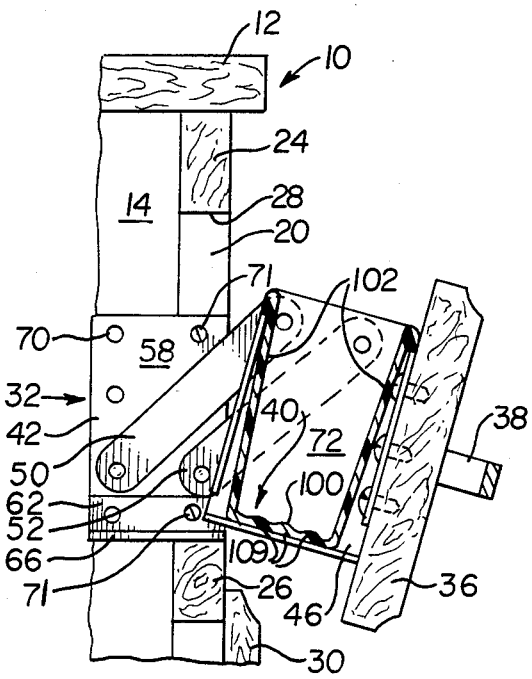
FIG. 3 is a sectional view similar to FIG. 2 but taken in the opposite direction with the receptacle or tray omitted from FIG. 2 replaced.
Figure 10:
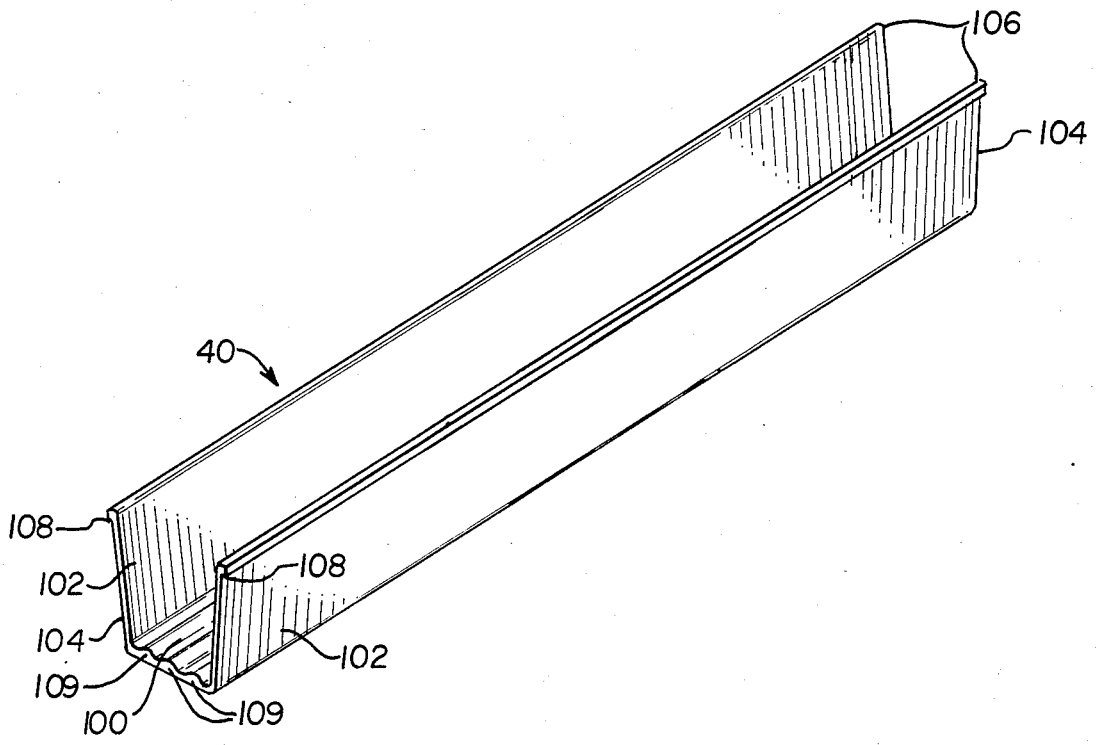
FIG. 10 is a perspective view of a receptacle or tray according to the invention.

Turning now particularly to FIGS. 3 and 10, receptacle or tray 40 is an extrusion of synthetic resinous material such as rigid polyvinyl chloride. The tray comprises an elongate base wall 100 and a pair of elongate sidewalls 102 extending upwardly from opposite sides of the base wall. The sidewalls cooperate to define an open top of the tray, and the base wall and the sidewalls cooperate to define opposite open ends 104 of the tray. Each sidewall terminates at its upper edge in an enlargement 106 which has an underside 108 extending laterally outwardly from the respective sidewall 102. Base wall 100 of the tray is preferably provided on its inner surface with longitudinal raised portions parallel with the sidewalls and with one another, the raised portions promoting drying of wet articles stored in the tray.

Installation

Figure 2:
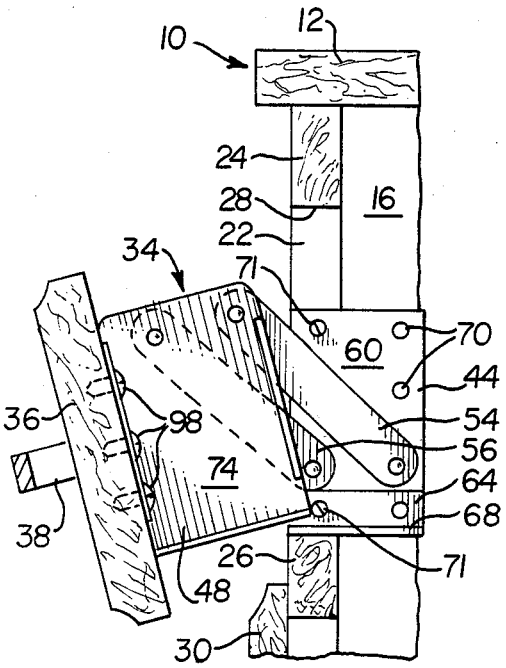
FIG. 2 is an enlarged sectional view taken along line 2—2 of FIG. 1 but with a receptacle or tray shown in FIG. 1 removed.

To incorporate the invention in sink cabinet 10, hinge assembly 32 is installed at the right-hand end of drawer opening 28 and hinge assembly 34 at the lefthand end, each being affixed respectively to vertical support member 20 or 22, by means of screws 71, entirely within drawer opening 28 in the positions shown in FIGS. 1, 2 and 3, with stop means 66 and 68 resting on horizontal frame member 26.

Figure 7:
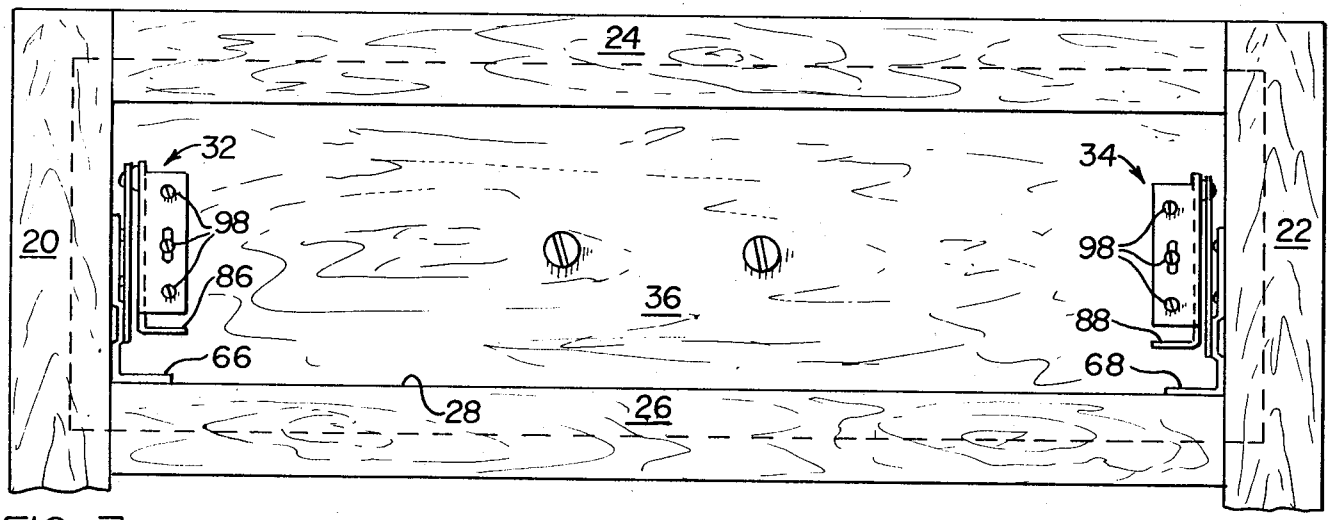
FIG. 7 is a partial elevational view of the front panel of the sink cabinet of FIG. 1, taken from inside the cabinet.
Figure 8:
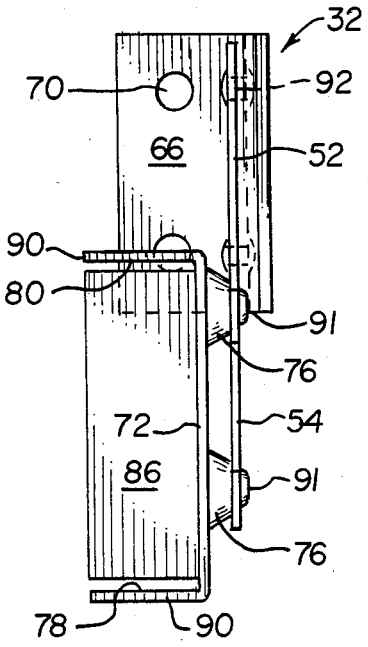
FIG. 8 is a top plan view of the hinge assembly of FIG. 6.
Figure 9:
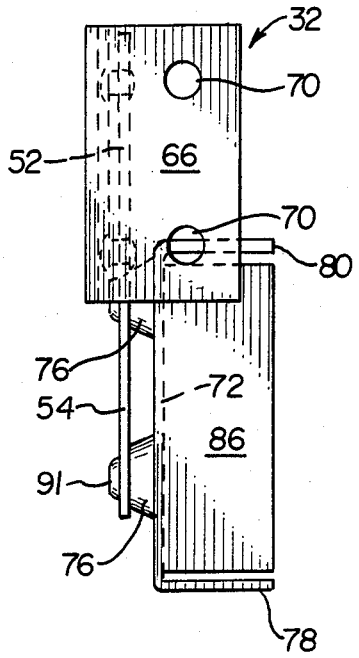
FIG. 9 is a bottom plan view of the hinge assembly of FIG. 6.

Next, drawer panel 36 is located relative to drawer opening 28 as shown by way of example in FIG. 7. Holes are then drilled in drawer panel 36 in the approximate centers of elongate openings 94 in outer tray support elements 78 and 82. The drawer panel is then preliminarily secured to the outer tray support elements by means of screws inserted through the elongate openings. Vertical alignment of the drawer panel can then be readily adjusted before four additional screws are applied through circular openings 96 to finally affix the drawer panel to hinge assemblies 32 and 34.

Because precise dimensions are likely to vary from installation to installation, it will probably be necessary to cut tray 40 to proper length to fit between drawer hinge plates 72 and 74. The tray is then inserted as shown in FIGS. 1 and 3, with undersides 108 of enlargements 106 resting on upper tray support surfaces 90 of drawer hinge members 46 and 48.

Operation

Figure 4:
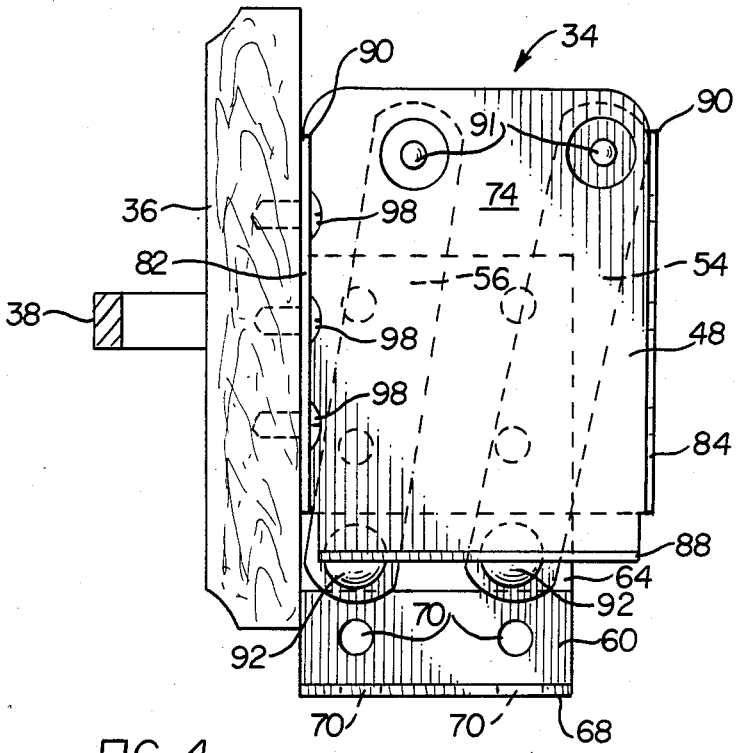
FIG. 4 is a further enlarged view similar to FIG. 2 and showing certain elements represented in FIG. in other relative positions.

It will now be apparent that drawer panel 36 is movable between a closed position, in which it closes drawer opening 28, as represented in FIGS. 4 and 7, its inner surface in abutting relation with the outer vertical surface of the cabinet provided by frame members 20, 22, 24 and 26, and a fully open position, in which the drawer panel is wholly spaced from the vertical wall formed by frame members 20, 22, 24 and 26 and lower panel member 30, as represented in FIGS. 1 to 3. The fully open position is established by the engagement of stop means 66 with stop means 86 and of stop means 68 with stop means 88.

Figure 5:
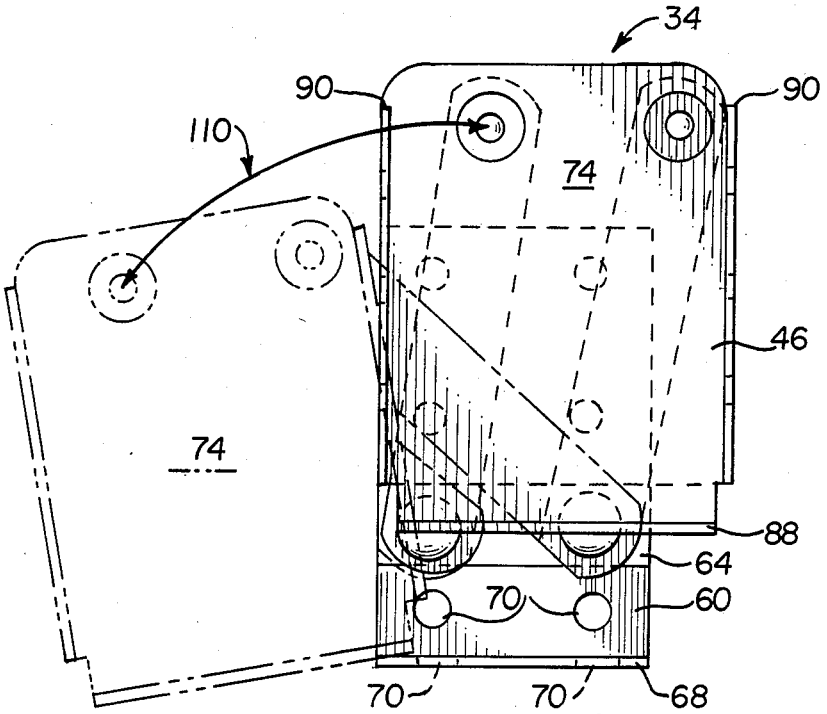
FIG. 5 is a view similar to FIG. 4 but representing movement of elements shown in FIG. 4 between two relative positions.

At the same time, drawer hinge plates 72 and 74, upon which drawer panel 36 is mounted, are movable between inner and outer positions corresponding respectively to the closed and fully open positions of the drawer panel, the outer position being represented in FIGS. 1, 2, 6, 8 and 9, and in phantom in FIG. 5, the inner position being represented in FIGS. 4 and 5. When the tray is received between the drawer hinge plates and supported on tray support elements 78, 80, 82 and 84, the tray is also movable between inner and outer positions corresponding respectively to the closed and fully open positions of drawer panel 36, the outer position of the tray being shown in FIGS. 1 and 3.

Such movement of drawer panel 36, drawer hinge plates 72 and 74, and tray 40 is afforded by the pivotal connections of hinge arms 50, 52, 54 and 56 with the respective cabinet hinge plate and drawer hinge plate, whereby each pair of hinge arms 50, 52 or 54, 56 is disposed for rotational movement relative to the respective cabinet hinge plate 58, 60 in the previously mentioned common planes and about axes normal to such common planes and parallel with the inner surface of drawer panel 36.

When drawer panel 36 is in its closed position, it will be evident that hinge assemblies 32 and 34 and tray 40 are entirely concealed from view from without the cabinet.

It is to be particulary noted that with the construction of the hinge assemblies 32 and 34 depicted in the drawings and described heretofore, the movement of any point on either of drawer hinge plates 72 and 74 (and consequently of any point on drawer panel 36 or tray 40) is confined to a single arc, as represented for example at 110 in FIG. 5, whereby each of drawer panel 36, drawer hinge plates 72 and 74, and tray 40 moves its own curved path between the closed or inner position on the one hand and the fully open or outer position on the other.

In the preferred embodiment it is particularly important that the drawer hinge plates 72 and 74 are mirror images of each other in that the upper pivotal connections of the respective hinge arms are offset toward the interior of the cabinet, as indicated in FIGS. 4 and 5 with respect to hinge assembly 34. Further, it is preferable that each of the pairs of hinge arms 50, 52; 54, 56 not be parallel with the other of the pair in planes common to the two but rather that the hinge arms of each pair diverge laterally from one another in the upward direction, as best seen in FIGS. 4 and 5. Finally, the pivotal connections at the upper and lower ends of the hinge arms are so related to one another that each hinge arm is inclined toward the interior of the cabinet when the respective drawer hinge plate 72, 74 is in its inner position, whereby the weight transmitted to such hinge arm by the drawer hinge plate acts to bias the drawer hinge plate in the direction of its inner position to hold drawer panel 36 in its closed position and tray 40 in its inner position until force is applied in the opposite direction, as by means of drawer pull 38.

The foregoing preferred features regarding the hinge arms also ensure that in the fully open position of drawer panel 36, the interior of the tray is wholly accessible, the tray being positioned at an angle with the vertical such that no contents are likely to spill from the tray, but its open top s fully exposed to the user.

While the invention has been particularly described in connection with a certain specific embodiment thereof, it is to be understood that this is by way of illustration and not of limitation, and the scope of the appended claims should be construed as broadly as the prior art will permit.

What is claimed is:

1. In combination, a storage tray of uniform cross section throughout its length and having a base wall and a pair of sidewalls upstanding from opposite sides of the base wall to define therewith opposite open ends of the tray, and a pair of hinge assemblies for supporting the tray on a sink cabinet for movement relative thereto between open and closed positions, each of the hinge assemblies comprising a cabinet hinge plate adapted to be affixed to the cabinet, a drawer hinge plate, hinge arm means supporting the drawer hinge plate on the cabinet hinge plate for movement relative thereto in a curved path, and tray support means carried by the drawer hinge plate for removably supporting the tray at a respective one of the opposite open ends thereof in a position whereby the drawer hinge plate froms an end wall closing said respective open end.

2. The combination according to claim 1, wherein at least the portions of each sidewall adjacent to said end portions of the tray are provided with enlargements, each enlargement having an underside extending laterally outwardly from the respective sidewall, the tray support means of each of the pair of hinge assemblies comprising a pair of tray supports extending from the respective drawer hinge plate in a direction away from the respective cabinet hinge plate nad positioned to receive a respective one of the opposite ends of the tray therebetween, each of the tray supports having an upper surface for engaging the underside of a respective one of the sidewall enlargments in supporting relation thereto.

3. The combination according to claim 1, wherein the hinge arm means of each of the pair of hinge assemblies comprises a pair of hinge arms disposed proximately adjacent to one another in common planes between and parallel with the respective caabinet hinge plate and drawer hinge plate, each of the hinge arms of each pair thereof having a first pivotal connection at an upper end thereof with the respective drawer hinge plate and a second pivotal connection at a lower end thereof with the respective cabinet hinge plate for rotational movement of the hinge arms in said common planes, the hinge arms of each pair thereof being of equal length between the respective first and second pivotal connections thereof.

4. The combination according to claim 3, wherein the hinge arms in said common planes diverge laterally from one another in the upward direction.

5. The combination according to claim 3, wherein the pivotal connections at the upper and lower ends of each of the hinge arms are so related to one another that the respective hinge arm is inclined toward the interior of the cabinet when the drawer hinge plate with which s aid hinge arm is connected is in the inner position thereof, whereby the weight transmitted to said hinge arm by said drawer hinge plate biases said drawer hinge plate in the direction of the inner position thereof.

6. The combination according to claim 5, wherein the drawer hinge plate of each of the pair of hinge assemblies is a mirror image of the drawer hinge plate of the other of the pair of hinge assemblies.

7. In a sink cabinet having a vertical wall, means defining an opening in the vertical wall, and a drawer panel adapted to cover the opening, the combination comprising a storage tray of uniform cross section throughout its length and having a base wall and a pair of sidewalls upstanding from opposite sides of the base wall to define therewith opposite open ends of the tray, and a pair of hinge assemblies mounting the drawer panel on the cabinet and supporting the tray thereon for movement relative thereto between a clossed position, in which the tray is wholly contained within the cabinet and the drawer panel closes the opening, and a fully open position, in which the drawer panel is spaced outwardly of the vertical wall and the interior of the tray is accessible from without the cabinet by way of the opening, each of the hinge assemblies comprising a cabinet hinge plate, a drawer hinge plate, hinge arm means supporting the drawer hinge plate on the cabinet hinge plate in parallel relation therewith for movement relatively thereto in a curved path, and tray support means carried by the drawer hinge plate for removably supporting the tray at a respective one of the opposite open ends thereof in a position whereby the drawer hinge plate forms an end wall closing said respective open end, the cabinet hinge plates of the respective hinge assemblies being affixed to and within the cabinet in horizontally spaced relation at opposite ends of the opening, the drawer hinge plates of the respective hinge assemblies being adapted to receive the drawer panel affixed thereto, each of the drawer hinge plates being movable in said pathe between an inner position corresponding to the closed position of the drawer panel and tray in which the drawer hinge plate is located within the opening and an outer position corresponding to the fully open position of the drawer panel and tray.

* * * * *